United States Patent [19]

Smith et al.

[11] Patent Number: 4,726,179

[45] Date of Patent: Feb. 23, 1988

[54] SPOOL RETAINER AND METHOD

[76] Inventors: J. Ronald Smith, 5000 Sparrow Ct., Pleasant Garden, N.C. 27313; J. Franklin Smith, 2005 Cleburne Dr., Greensboro, N.C. 27408

[21] Appl. No.: 8,540

[22] Filed: Jan. 29, 1987

[51] Int. Cl.[4] ..... D01H 7/16; B65H 54/54

[52] U.S. Cl. ..... 57/129; 57/132; 242/46.2; 242/46.6

[58] Field of Search ..... 57/112, 127.5, 127.7, 57/129, 132; 242/46.6, 46.7, 46.8, 118.5, 118.6, 118.61, 129, 129.5, 129.7, 129.71, 129.72, 130, 130.1, 134

[56] References Cited

U.S. PATENT DOCUMENTS

| | | | |
|---|---|---|---|
| 1,870,202 | 8/1932 | Gollong | 57/129 |
| 2,209,428 | 7/1940 | Taylor et al. | 242/129.7 |
| 3,044,247 | 7/1962 | Hilbert | 57/77.45 |
| 3,134,218 | 5/1964 | Hilbert | 57/104 |
| 4,157,006 | 6/1979 | Guillot | 57/129 X |
| 4,423,609 | 1/1984 | Itoh | 242/129.71 |
| 4,462,555 | 7/1984 | Olson et al. | 242/118.6 |

FOREIGN PATENT DOCUMENTS

| | | | |
|---|---|---|---|
| 1061235 | 7/1959 | Fed. Rep. of Germany | 57/127.5 |
| 39659 | 3/1984 | Japan | 57/129 |

OTHER PUBLICATIONS

New Omm Covering Machine Brochure—Apr. 1978. Photo demonstrating old spindle and spool retainer.

*Primary Examiner*—Donald Watkins

[57] ABSTRACT

A spool retainer and method are presented which greatly increase the speed and efficiency of textile workers in changing spools on yarn covering machines. The spool retainer has an outer sleeve resiliently affixed to an inner plunger which allows the operator ease and convenience in changing yarn spools and make the doffing operation less expensive and time consuming.

17 Claims, 4 Drawing Figures

SPOOL RETAINER AND METHOD

BACKGROUND OF THE INVENTION

1. Field of the Invention

The present invention relates to spool retainer for yarn spindles and specifically for high speed spindles as used in textile mills on yarn covering machines.

2. Description of the Prior Art and Objectives of the Invention

High speed spindles which rotate at 20–30 thousand rpms have been used in the textile industry on covering machines and other equipment for many years. Such spindles receive a spool containing yarn and operate without a vertical retainer or with a solid retainer which attaches to the top of the spindle blade to secure the spool on the spindle. In using conventional solid spool retainers, the spool is placed on the spindle and the operator grasps the spool of yarn with one hand and urges the spool downwardly against a rotatable resilient member. While the spool is so depressed, with the other hand, the operator positions the spool retainer on the top of the spindle blade and into the spool. Once the conventional retainer is so positioned the operator rotates the retainer until the retainer "seats" itself into grooves or slots provided in the spindle blade. Thus with conventional spindles and spool retainers, the yarn spool is limited to a certain height and yarn capacity since the spool must fit on the spindle blade below the top of the blade so the retainer can properly seat on the spindle within the spool to secure the spool. Also, conventional spool retainers are oftentimes difficult to engage by the operator since one hand must depress and hold the yarn spool against a strong spring while the other hand adjust and seats the retainer. This is difficult and may severly damage the outer layers of yarn.

With this background and disadvantage known of conventional spool retainer designs, the present invention was conceived and one of its objective is to provide a highly durable yarn spool retainer which alleviates the problems associated with conventional spindles.

It is another objective of the present invention to provide a yarn spool spindle which will carry a yarn spool having a greater axial length than the spindle blade.

It is still another objective of the present invention to provide a yarn spool spindle having a retainer which is releasably engagable with the spindle blade under relatively low tension and which includes a spool retainer having an outer sleeve and an inner plunger which are resiliently coupled.

It is still yet another objective of the present invention to provide a method for retaining a spool on a rotatable spindle whereby the operator can easily change yarn spools with minimum effort and time.

Various other objectives and advantages of the present invention will become apparent to those skilled in the art as a more detailed explanation of the invention is set forth below.

SUMMARY OF THE INVENTION

The aforementioned and other objectives of the invention are accomplished by utilizing a yarn spool spindle having a spool retainer which consists of an outer sleeve with an inner plunger. The plunger is resiliently affixed to the sleeve whereby the retainer can easily be placed in the spool and the plunger depressed and rotated for engagement with the spindle blade "J" slot.

The top of the spindle blade does not need to extend above the height of the spool and can be lower than the top of the spool since the spool retainer penetrates substantially into the spool for engagement with the spindle blade.

DESCRIPTION OF THE PREFERRED EMBODIMENT

A yarn spool spindle includes a base having a bearingly mounted blade with a lower spool hub positioned in close proximity to the base. The "filler" or supply yarn is mounted below the spindle and enters the base port and is directed upwardly through the spindle and out of the top of the spindle blade for eventual covering. At the top or open end of the blade a pair of J-shaped grooves or notches are opposingly positioned for engaging the spool retainer. The preferred form of the spool retainer includes a plunger having a barrel with a bore whereby the spindle blade will fit within the bore. A sleeve is slidably positioned along the outside of the barrel of the plunger and a coil spring resiliently connects the sleeve and barrel. An upper spool hub is positioned on the outside of the sleeve and the upper spool hub and plunger are molded from a durable plastic or other suitable materials. A pair of opposingly positioned studs extend radially from the barrel into the bore for cooperative engagement with the slots or grooves located in the spindle blade.

The preferred method of retaining a spool on the rotatable spindle includes the steps of placing a spool on the spindle blade and inserting the spool retainer into the spool so positioned. The spool plunger is then depressed and rotated to allow the studs which extend into the bore of the barrel of the plunger to engage the J-shaped slots positioned along the top of the spindle blade. The plunger is then depressed whereby the studs move downwardly into the grooves and the plunger is then rotated in a first direction whereby the studs travel horizontally along the bottom of the J-shaped groove and thereafter the plunger is released whereby the studs move slightly upwardly into the tip of the "J" slots to maintain the spool securely on the spindle.

DETAILED DESCRIPTION OF THE DRAWINGS

Figure 1:
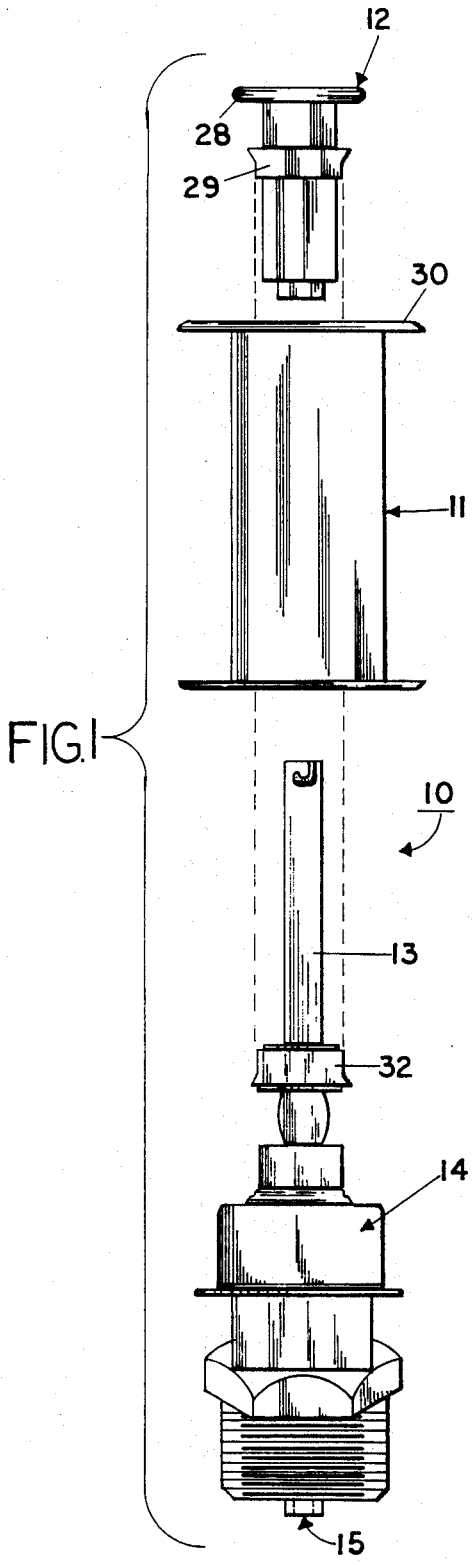
FIG. 1 illustrates the retainer of the present invention with a yarn spool and spindle exploded therefrom.

For a more complete understanding of the invention and its method of operation, FIG. 1 shows in exploded fashion spool spindle 10 with an empty yarn spool 11 positioned thereabove and spool retaining means 12 is shown above yarn spool 11. Spindle 10 is of the high speed type and spindle blade 13 may turn at speeds in excess of 20,000 rpms when in operation and used for supplying a covering yarn such as nylon, polyester or other synthetic, natural or metallic yarns for covering elastic, metallic, synthetic or natural yarns as desired.

Spindle 10 may be used along with any other similar type spindles on various types of covering machines such as an OMM covering machine as manufactured by Officine Meccaniche Menegatto S.P.A. of Monza, Italy.

Figure 2:
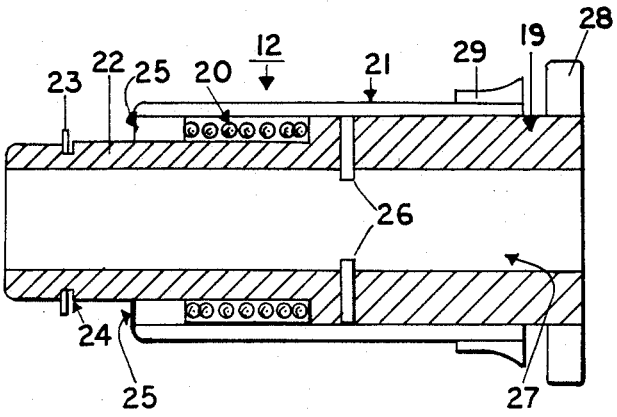
FIG. 2 demonstrates a cross-sectional enlarged view of the spool retainer as seen in FIG. 1.
Figure 3:
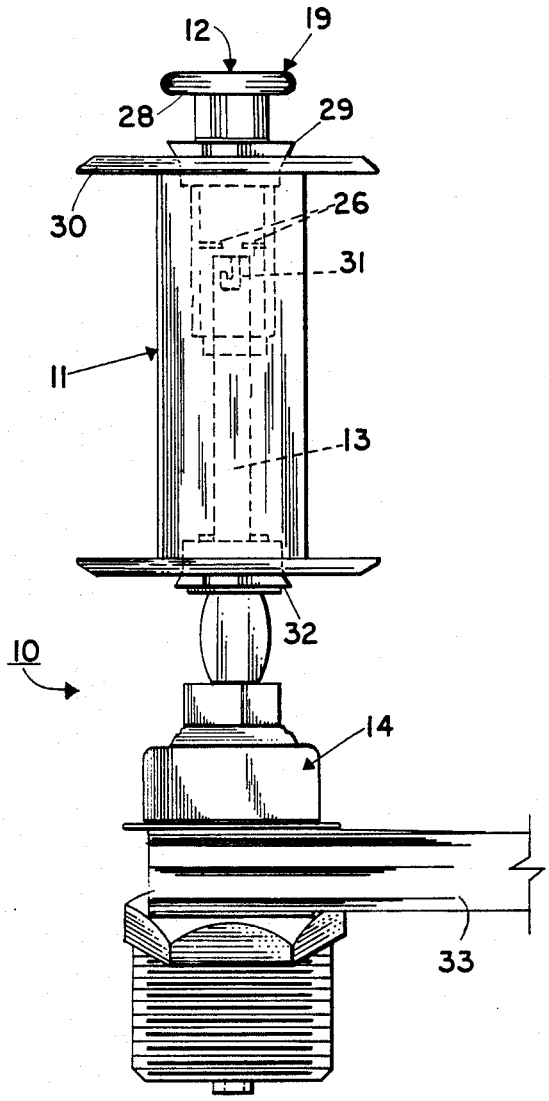
FIG. 3 illustrates (with dotted lines) a yarn spool with the spool retainer inserted but before the spool retainer engages the spindle blade.
Figure 4:
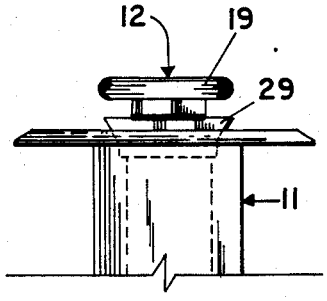
FIG. 4 demonstrates the top of the spool retainer with the plunger depressed as with the retainer in engagement with the spindle blade.

Spool retaining means 12 is shown enlarged in cross-section in FIG. 2 and includes plunger 19 which is resiliently mounted by coil spring 20 to sleeve 21. Plunger 19 includes barrel 22 which at one end is fitted with vertical stop means 23 consisting of a spring clip which sits within clip groove 24. Stop means 23 prevents excess downward motion of sleeve 21 and stops the movement of sleeve 21 relative to barrel 22 as sleeve bottom area 25 contacts stop means 23. Plunger 19 includes sleeve fastening means 26 which consist of a pair of opposingly positioned cylindrical studs which extend slightly into bore 27 of barrel 22. Plunger 19 also includes top collar 28 and on the outer surface of sleeve 21 near collar 28 is located spool hub 29 which frictionally engages the inner surface of upper rim 30 of spool 11 as seen in FIG. 3. As would be understood from FIG. 2, sleeve 21 slides along the outer surface of barrel 22 and can freely turn therearound. FIG. 2 demonstrates plunger 19 in a depressed state as for example when engaged with spindle blade 13 as shown in FIG. 4. In FIG. 1 collar 28 is shown at a greater distance above upper spool hub 29 when compared to FIG. 2 as spool retaining means 12 in FIG. 1 is in its relaxed or extended posture.

FIG. 4 depicts plunger 19 in its depressed position whereas FIG. 3 shows spool retaining means 12 in extended fashion. As seen in FIG. 3, blade fastening means 26 requires rotation so that fastening means 26 align with "J" slot 31 on spindle blade 13. As understood, a pair of "J"-slots 31 are positioned on opposite sides at the top of blade 13 and when plunger 19 is properly aligned, and upon depressing, fastening means 26 ride downwardly into the longer vertical groove of "J"-slot 31. Upon rotation of plunger 19 in a clockwise direction as shown in FIG. 3, fastening means 26 move horizontally across the bottom of the "J" and upon release of pressure from plunger 19 thereafter, fastening means 26 move slightly upward into the tip of the "J", allowing fastening means 26 to lock into place and providing secure engagement for spool 11 on blade 13. Thereafter, spindle 10 can be rotated at high rpms by belt 33 which is joined to a conventional power source (not shown) while spool 11 remains safely in place.

To use spindle 10, a suitably dimensioned yarn spool 11 which may contain polyester or other yarn is placed on spindle blade 13 where it rests on lower spool hub 32. As seen in FIG. 3, spool 11 has a greater axial length than spindle blade 13 thereby allowing a large capacity of yarn to be wound thereon. Spool retaining means 12 is positioned in the top of spool 11 as sleeve 21 can slide downward into spool 10. Plunger 19 is then rotated until blade fastening means 26 "finds" "J"-slot 31 as shown in FIG. 3 at which time plunger 19 is depressed, rotated slightly in a first direction and then allowed to extend upwardly as blade fastening means 26 rises within the tip of "J"-slot 31. With spool retaining means 12 so engaged, spindle 10 can then be driven by a convention belt 33 as shown in FIG. 3.

Once spool 11 is depleted of yarn, the power source or drive means (not shown) which turns belt 33 is disengaged and the operator can easily remove empty spool 11 by depressing plunger 19 with slight finger pressure, rotating it in a second direction and allowing coil spring 20 to extend plunger 19 upwardly. Thereafter spool retaining means 12 is extracted from spool 11 and a filled yarn spool is then placed on spindle blade 13 and the method of securing the spool is repeated. The doffing time of a typical covering machine can be reduced 75% with this invention thereby increasing the productivity of the machinery as it provides more time for covering yarn along with reducing operators' fatigue and eliminating damage to the outer layers of yarn.

Various changes and modifications can be made to the invention by those skilled in the art and the examples and illustrations which are shown are merely for illustrative purposes and are not intended to limit the scope of the appended claims.

We claim:

1. Spool retaining means for placement within a spool and attachment to a rotatable spindle blade to maintain the spool on the spindle blade during rotation thereof comprising: a plunger, said plunger having a large outer diameter portion and a small outer diameter portion, said larger outer diamter portion joined to said small outer diameter portion, a sleeve, said plunger slidably positioned within said sleeve, a resilient member, said resilient member positioned on said small outer diameter portion of said plunger and concealed between said plunger and said sleeve, and said plunger having a bore for receiving the spindle blade for releasable engagement therewith.

2. Spool retaining means as claimed in claim 1 wherein said plunger includes blade fastening means.

3. Spool retaining means as claimed in claim 2 wherein said blade fastening means comprises radially positioned studs which extend into said bore.

4. Spool retaining means as claimed in claim 1 wherein said blade includes fastening means receiver consisting of slots.

5. Spool retaining means as claimed in claim 1 wherein said plunger includes a collar.

6. Spool retaining means as claimed in claim 1 wherein said sleeve is resiliently attached to said plunger.

7. Spool retaining means as claimed in claim 1 wherein said plunger includes vertical stop means.

8. Spool retaining means comprising: a plunger, said plunger having a barrel, said barrel having a large outer diameter portion and a small outer diameter portion, said large outer diameter portion joined to said small outer diameter portion, a collar, said collar positioned on said large outer diameter portion, a sleeve, said sleeve slidable along the outside of said barrel, a resilient member, said resilient member positioned on said small outer diameter portion of said barrel and concealed between said plunger and said sleeve, said barrel having a bore therethrough, whereby the spindle blade can be inserted into the bore for releasable engagement of the retaining means on the spindle blade.

9. Spool retaining means as claimed in claim 8 wherein said sleeve includes a spool hub.

10. Spool retaining means as claimed in claim 8 and including stop means, said stop means positioned on said barrel.

11. Spool retaining means as claimed in claim 8 wherein said resilient member comprises a coil spring.

12. Spool retaining means as claimed in claim 8 wherein said barrel includes spindle blade fastening means.

13. A method to maintain a spool on a rotatable spindle blade, said blade having a slot therein, a spool retaining means, the retaining means having a plunger slidably positioned within a sleeve and said plunger having blade fastening means thereon, a resilient member concealed between said plunger and said sleeve, by the steps comprising:

(1) placing a spool on the spindle blade, (2) inserting the spool retaining means into the spool, and (3) depressing and rotating the plunger in a first direction within the sleeve to compress the resilient member and to engage the blade fastening means within the spindle blade slot to secure the spool onto the spindle blade.

14. A method for retaining a spool on a rotatable spindle as claimed in claim 13 wherein the step of placing a spool on the spindle blade comprises the step of placing the spool on the spindle blade whereby the spool extends over the blade beyond the axial length of the spindle blade.

15. A method for retaining a spool on a rotatable spindle as claimed in claim 13 wherein the step of rotating the plunger in a first direction comprises rotating the plunger into releasable engagement with the spindle blade.

16. A method for retaining a spool on a rotatable spindle as claimed in claim 13 and including the step of releasing the plunger and allowing the plunger to return partially from its depressed posture.

17. A method for retaining a spool on a rotatable spindle as claimed in claim 13 and including the step of depressing the plunger and rotating it in a second direction to disengage the plunger from the spindle blade.

* * * * *